US010900254B2

(12) United States Patent
Murphy et al.

(10) Patent No.: US 10,900,254 B2
(45) **Date of Patent: *Jan. 26, 2021**

(54) CONFIGURABLE DOOR LOCK

(71) Applicant: Schlage Lock Company LLC, Carmel, IN (US)

(72) Inventors: Nathanael S. Murphy, Colorado Springs, CO (US); Michael Holman, Fishers, IN (US)

(73) Assignee: Schlage Lock Company LLC, Carmel, IN (US)

( * ) Notice: Subject to any disclaimer, the term of this patent is extended or adjusted under 35 U.S.C. 154(b) by 34 days.

This patent is subject to a terminal disclaimer.

(21) Appl. No.: 16/209,001

(22) Filed: Dec. 4, 2018

(65) Prior Publication Data

US 2019/0106904 A1 Apr. 11, 2019

Related U.S. Application Data

(63) Continuation of application No. 15/466,389, filed on Mar. 22, 2017, now Pat. No. 10,604,964.
(Continued)

(51) Int. Cl.
*E05B 13/00* (2006.01)
*E05B 63/00* (2006.01)
(Continued)

(52) U.S. Cl.
CPC ..... *E05B 13/004* (2013.01); *E05B 55/005* (2013.01); *E05B 63/0056* (2013.01);
(Continued)

(58) Field of Classification Search
CPC ..... E05B 13/004; E05B 13/002; E05B 13/00; E05B 13/101; E05B 55/00; E05B 55/05;
(Continued)

(56) References Cited

U.S. PATENT DOCUMENTS 3,869,161 A * 3/1975 Meroni ..... E05B 55/005 292/166
4,470,278 A * 9/1984 Hale ..... E05B 55/12 292/169.18

(Continued)

OTHER PUBLICATIONS

New Zealand Examination Report; New Zealand Intellectual Property Office; New Zealand Patent Application No. 747290; dated Sep. 19, 2019; 4 pages.

(Continued)

*Primary Examiner* — Nathan Cumar
(74) *Attorney, Agent, or Firm* — Taft Stettinius & Hollister LLP

(57) ABSTRACT

A lock for a door including a configurable lock function. The lock includes a removable and user accessible actuator which when removed from the lock disables a lock function, and when inserted into the lock enables the lock function. Removal of the actuator places the lock in a disabled condition in which the lock cannot be locked by other means. Insertion of the actuator into the lock places the lock in an enabled condition in which the lock is locked or unlocked by the position of the actuator. The lock is installed without the actuator when the lock is intended to be used only in a passage operation where the door provides access only, but does not restrict access. The lock is installed with the actuator when the lock is intended to be used in a privacy operation where the lock is intended to restrict access to an area.

21 Claims, 9 Drawing Sheets

Related U.S. Application Data

(60) Provisional application No. 62/311,996, filed on Mar. 23, 2016, provisional application No. 62/312,206, filed on Mar. 23, 2016.

(51) Int. Cl.
*E05C 1/16* (2006.01)
*E05B 55/00* (2006.01)

(52) U.S. Cl.
CPC ..... *E05B 63/0065* (2013.01); *E05B 63/0069* (2013.01); *E05C 1/163* (2013.01)

(58) Field of Classification Search
CPC ..... E05B 47/0676; E05B 63/0056; E05B 63/0065; E05B 63/0069; E05B 63/1086; E05C 9/20; E05C 9/105; E05C 1/16; E05C 1/163
USPC ..... 292/138
See application file for complete search history.

(56) References Cited

U.S. PATENT DOCUMENTS 4,920,773 A * 5/1990 Surko, Jr. ..... E05B 55/06 70/224
5,598,726 A * 2/1997 Cordle ..... E05B 55/005 292/336.3
5,901,590 A * 5/1999 Lai ..... E05B 13/106 292/DIG. 37
9,982,455 B2 * 5/2018 Badhya ..... E05B 55/005
2006/0042336 A1 * 3/2006 Smith ..... E05B 13/004 70/432
2009/0056392 A1 * 3/2009 Brannaman ..... E05B 17/005 70/91
2011/0289987 A1 * 12/2011 Chiou ..... E05B 7/00 70/91
2012/0267903 A1 * 10/2012 Welsby ..... E05B 55/005 292/145
2014/0191516 A1 * 7/2014 Badhya ..... E05B 55/005 292/145
2015/0076845 A1 * 3/2015 Ou ..... E05B 63/006 292/358

OTHER PUBLICATIONS

Australian Examination Report; Australia Patent Office; Australian Patent Application No. 2017237062; dated Sep. 30, 2019; 2 pages.
Australian Examination Report; Australia Patent Office; Australian Patent Application No. 2017237062; dated May 22, 2019; 3 pages.
Supplementary European Search Report; European Patent Office; European Patent Application No. 17771156.1; dated Oct. 21, 2019; 6 pages.
International Search Report; International Searching Authority; International Patent Application No. PCT/US2017/023817; dated Jun. 19, 2017; 2 pages.
International Written Opinion; International Searching Authority; International Patent Application No. PCT/US2017/023817; dated Jun. 19, 2017; 5 pages.
Canadian Office Action; Canadian Intellectual Property Office; Canadian Patent Application No. 3,018,767; dated Sep. 13, 2019; 3 pages.
New Zealand Examination Report; New Zealand Intellectual Property Office; New Zealand Patent Application No. 747290; dated Jan. 22, 2020; 3 pages.
New Zealand Examination Report (4th); New Zealand Intellectual Property Office; New Zealand Patent Application No. 747290; dated May 20, 2020; 3 pages.
New Zealand Examination Report; New Zealand Intellectual Property Office; New Zealand Patent Application No. 747290; dated Apr. 29, 2019; 3 pages.
Canadian Office Action; Canadian Intellectual Property Office; Canadian Patent Application No. 3,018,767; dated Aug. 4, 2020; 3 pages.

* cited by examiner

CONFIGURABLE DOOR LOCK

CROSS-REFERENCE TO RELATED APPLICATIONS

The present application is a continuation of U.S. patent application Ser. No. 15/466,389 filed Mar. 22, 2017, which claims the benefit of U.S. Provisional Patent Application No. 62/311,996 filed Mar. 23, 2016, and U.S. Provisional Patent Application No. 62/312,206 filed Mar. 23, 2016, the contents of each application incorporated herein by reference in their entirety.

TECHNICAL FIELD

The present disclosure relates to locksets, and more particularly, but not exclusively, relates to tubular locksets.

BACKGROUND

Tubular lock mechanisms are commonly used in securing doors. Certain locks of this type are configured for privacy functionality, and include a removable actuator button through which a user can adjust the lock between locked and unlocked states. While the locking mechanism is not directly operable when the button is removed, the lock may still configured for privacy functionality, and all modes of privacy operation may still be enabled. For example, certain locks of this type can be locked by inserting an appropriately-sized object into the space formerly occupied by the button to effect locking of the mechanism.

Door locks that are manufactured for use in the residential home environment are typically offered in a relatively limited number of available lock functions, each corresponding to a particular environment in which the lock may be installed. Common functions, and the environments in which they are typically installed, include: passage function (e.g., hallway and closet doors), privacy function (e.g., bedroom and bathroom doors), dummy or inactive function (e.g., pantry doors), keyed entrance function (e.g., exterior doors), and handleset entrance function (e.g., exterior doors). These can be consolidated into two primary groups: interior functions (e.g., passage, privacy, and dummy functions), and exterior functions (e.g., keyed entrance and handleset entrance functions).

In the case of interior functions, passage and privacy are the most common, and are used in a majority of all interior lock installations. In certain product lines, the functionality of the lock is pre-determined by the lock manufacturer and cannot be subsequently changed by the consumer. For a consumer interested in purchasing locks of this type, the consumer typically determines the number of doors in the home for which the passage function or privacy function is desired, purchases the appropriate quantities of each function, and installs the locks on the doors. To change locking functionality for a given door, a new lock must be purchased with the desired function. While the purchase of a new lock to change the functionality of a door is commonly performed, the change requires an expenditure of time and money, which many consumers would like to avoid. In addition, the lock being replaced is often still fully functional, and the fact that is no longer used may be considered wasteful.

As is evident from the foregoing, certain conventional locksets have drawbacks and limitations. For these reasons among others, there remains a need for further developments in this technological field.

SUMMARY

One aspect of the present application is directed to a door lock having a locked state and an unlocked state. The door lock includes an outside chassis assembly, a latch, and an inside chassis assembly. The inside chassis assembly includes a locking structure and an actuator configured to engage the locking structure, wherein the actuator when engaged with the locking structure provides a locking mode configured to enable the door lock to be placed in one of the locked state and the unlocked state. The actuator when disengaged from the locking structure provides a passage mode configured to place the door lock in only the unlocked state.

Another aspect of the present application is directed to a chassis assembly configured for a door lock having a locked state and an unlocked state. The chassis assembly includes a locking structure and an actuator configured to engage the locking structure. The actuator when engaged with the locking structure provides a locking mode configured to enable the door lock to be placed in one of the locked state and the unlocked state. The actuator when disengaged from the locking structure provides a passage mode configured to place the door lock in only the unlocked state.

A further aspect of the present application is directed to a method of establishing an operating condition of a lock configured to be in locked state or an unlocked state. The method includes providing an aperture in the lock, providing an actuator configured to fit in the aperture, inserting the actuator into the aperture, wherein the insertion without further movement maintains the lock in an unlocked state, rotating the actuator with respect to the lock, and applying a camming force to move a slider along a linear axis defined by the actuator in a first direction after the rotating of the actuator to set the lock in the locked state. In certain forms, the method further comprises providing the aperture with a keyway, and providing the actuator with a key, wherein the inserting the actuator into the aperture includes inserting the key into the keyway by first aligning the key with the keyway, preventing linear movement of the actuator after the inserting of the actuator into the aperture but before the rotating the actuator, restricting the pushing force from further movement along the linear axis to set the lock to the locked state, applying a pulling force after the applying of the pushing force to move the actuator along the linear axis in a second direction opposite the first direction, wherein the applying the pulling force to set the lock in the unlocked state, and preventing linear movement of the actuator after the inserting the actuator into the aperture but before the rotating the actuator.

DETAILED DESCRIPTION OF ILLUSTRATIVE EMBODIMENTS

Figure 1:
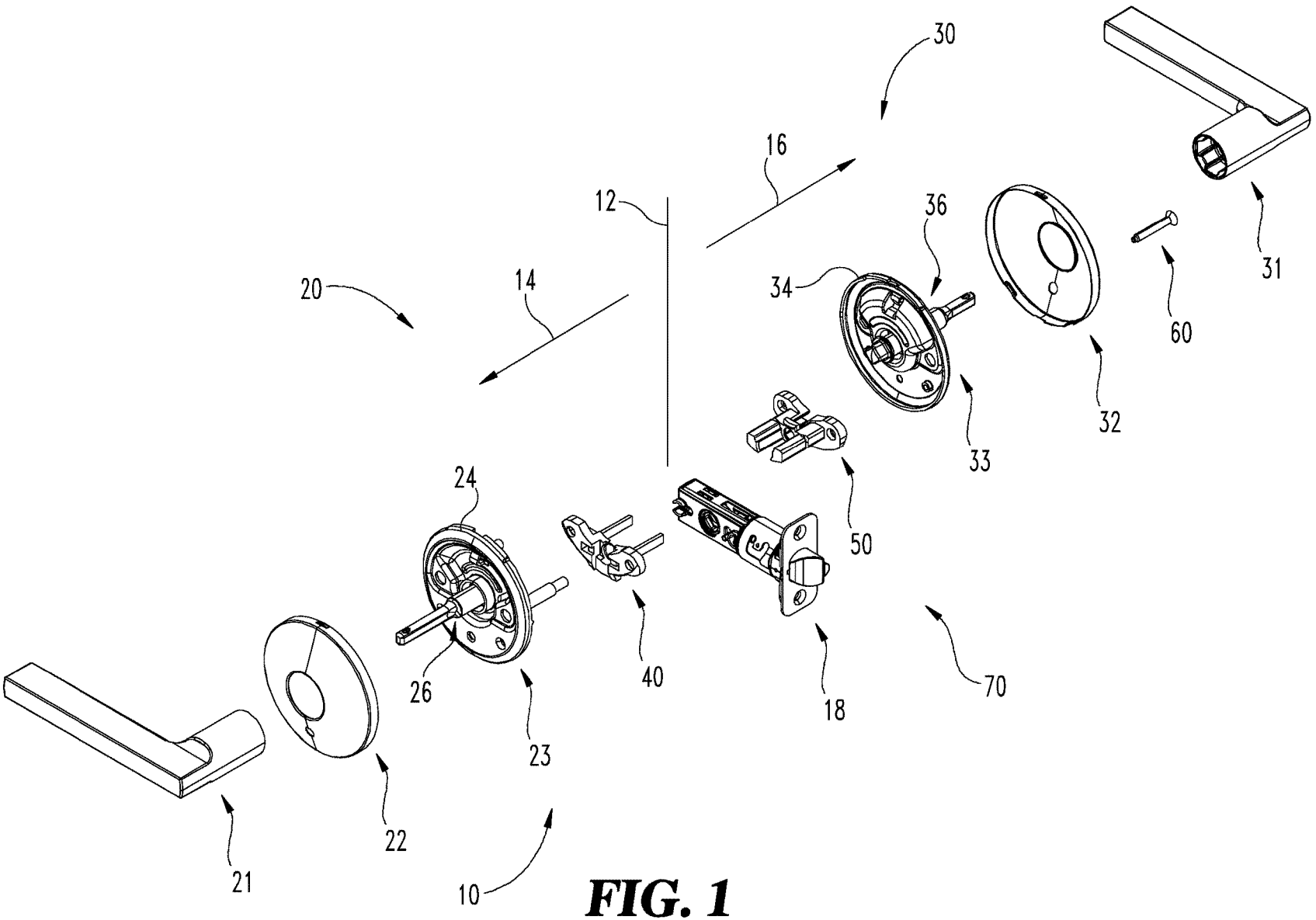
FIG. 1 is an exploded perspective view of a tubular lock according to one embodiment.

For the purposes of promoting an understanding of the principles of the invention, reference will now be made to the embodiments illustrated in the drawings where specific language is used to describe the same. It should be understood that no limitation of the scope of the invention is thereby intended. Any alterations and further modifications in the described embodiments, and any further applications of the principles of the invention as described herein are contemplated as would normally occur to one skilled in the art to which the invention relates.

FIG. 1 illustrates a tubular lockset or lock assembly 10 according to one embodiment of the present disclosure. As illustrated in FIG. 1, a line 12 distinguishes between exterior and interior portions of the lock assembly 10. When installed in a door, the lock assembly 10 extends toward an exterior side of the door in the direction of a line 14, and extends toward an interior side of the door, adjacent to a room interior for instance, in the direction of a line 16.

The lock assembly 10 includes a latch 18, an outside assembly 20, an inside assembly 30, and a locking mechanism 70. The outside assembly 20 includes an outside handle 21, an outside rose 22, and an outside chassis assembly 23 including an outside chassis housing 24 and an outside spindle 26 on which the outside handle 21 is mounted. Similarly, the inside assembly 30 includes an inside handle 31, an inside rose 32, and an inside chassis assembly 33 including an inside chassis housing 34 and an inside spindle 36 on which the inside handle 31 is mounted. Each of the handles 21, 31 is connected to the latch 18 through the corresponding chassis assembly 23, 33 such that rotation of either handle 21, 31 causes movement of the latch 18.

The lock mechanism 70 includes an outside locking module 40, an inside locking module 50, and may further include a locking module actuator 60. Additionally, the outside assembly 20 may be considered to include the outside locking module 40, and the inside assembly 30 may be considered to include the inside locking module 50. In the illustrated embodiment, the locking modules 40 and 50 are self-contained modular subassemblies that are mounted to the housings 24, 34. In other embodiments, one or both of the locking modules 40, 50 may be integral to the corresponding one of the outside and inside assemblies 20, 30.

As described in further detail below, the locking mechanism 70 is selectively operable in each of a plurality of configurations, including a privacy configuration and a passage configuration. In the privacy configuration, the locking mechanism 70 includes the actuator 60, which may be manipulated by a user to transition the locking mechanism 70 between a locked state and an unlocked state. In the passage configuration, the actuator 60 is removed, and the locking mechanism remains in the unlocked state. In certain embodiments, the actuator 60 provides a push-button user interface for adjusting the locked/unlocked state of the locking mechanism 70. When installed, the actuator 60 is typically accessible from the inner side of the door to enable a user to lock the door to prevent others from entering the room.

Figure 2:
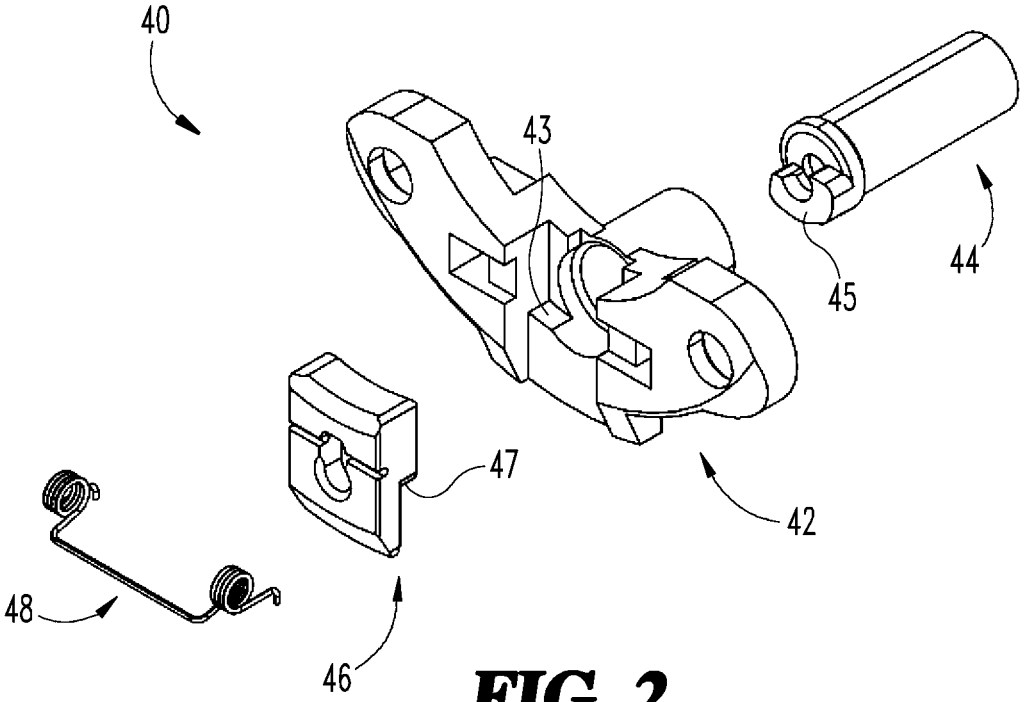
FIG. 2 is an exploded perspective view of an outside locking module.

FIG. 2 is an exploded perspective view of the outside locking module 40. In the illustrated embodiment, the outside locking module 40 includes an outside lock housing 42, a cam shaft 44 rotatably mounted to the housing 42, a locking member in the form of a locking lug 46 slidably mounted to the housing 42 and engaged with the cam shaft 44, and a biasing member 48 engaged with the housing 42 and the locking lug 46. The housing 42 is mounted to the outside chassis housing 24 and extends toward the inside chassis housing 34. The cam shaft 44 includes a cam 45 that is engaged with the locking lug 46 and converts rotation of the cam shaft 44 to linear movement of the locking lug 46. The locking lug 46 is movable between a locking position and an unlocking position, and is biased toward the unlocking position by the biasing member 48. The locking lug 46 may include a shoulder 47 that is engaged with a corresponding shoulder 43 of the housing 42 when the locking lug 46 is in the unlocking position.

Figure 3:
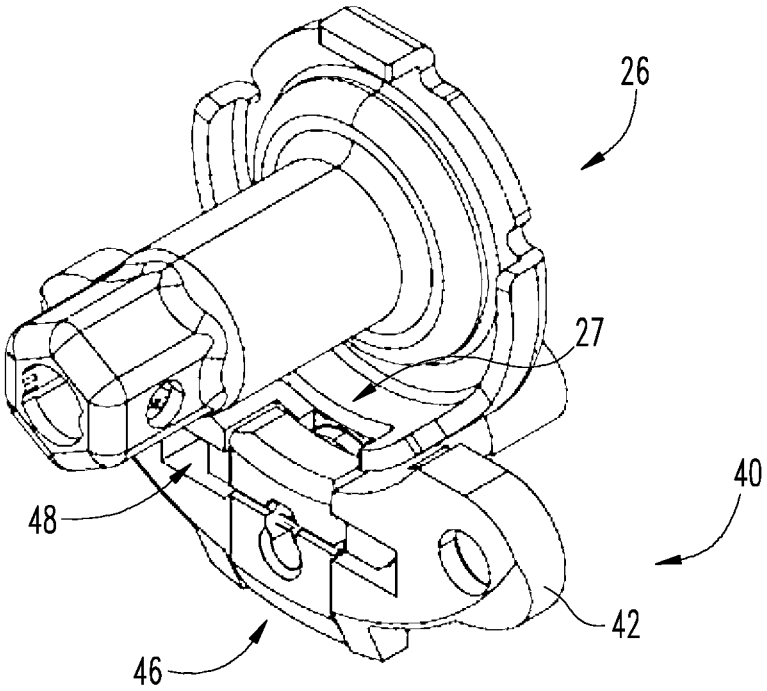
FIG. 3 is a perspective view of the outside locking module and a spindle.

FIG. 3 is a perspective view of the outside spindle 26 and the outside locking module 40 with the locking mechanism 70 in the unlocked state. The outside spindle 26 includes a gap 27 operable to receive the locking lug 46. With the locking mechanism 70 in the unlocked state, the locking lug 46 is in the unlocking position, in which the locking lug 46 does not extend into the gap 27. As a result, the outside spindle 26 is able to rotate, and the outside handle 21 is capable of retracting the latch 18. With the locking mechanism 70 in the locked state, the locking lug 46 is in the locking position, in which the locking lug 46 extends into the gap 27. As a result, the locking lug 46 prevents rotation of the outside spindle 26, and the outside handle 21 is not capable of retracting the latch 18. As noted above, the locking lug 46 is configured to move between the locking and unlocking positions in response to rotation of the cam shaft 44.

Figure 4:
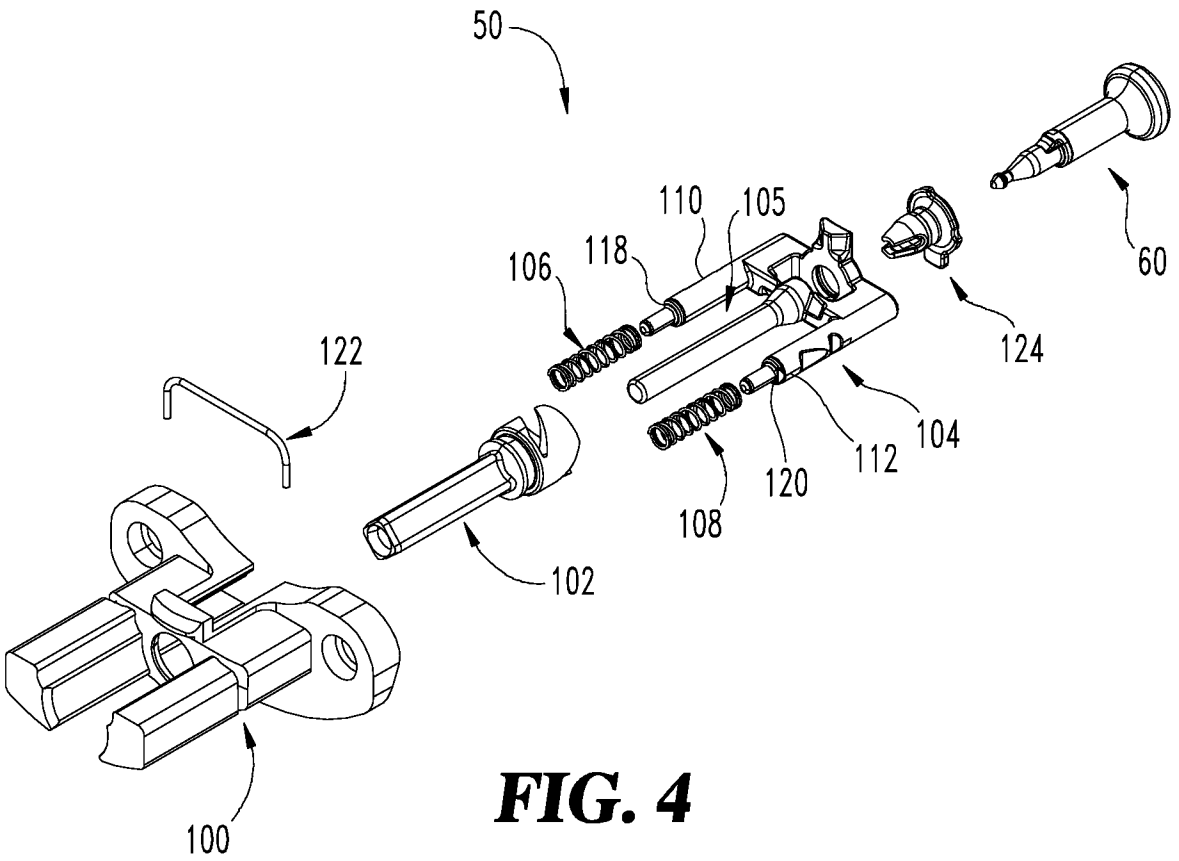
FIG. 4 is an exploded perspective view of an inside locking module and an actuator.

FIG. 4 is an exploded perspective view of the inside locking module 50 and the actuator 60. The inside locking module 50 includes an inside lock housing 100 configured as a fixed/rigid base component that is mounted to the inside chassis housing 34. The inside locking module 50 includes a locking shaft 102 and a slider 104, which includes a post 105 on which the locking shaft 102 is rotatably mounted. The locking shaft 102 is rotationally coupled with the cam shaft 44, and is configured to rotate in response to axial motion of the slider 104. A first compression spring 106 and a second compression spring 108 are disposed between the slider 104 and the housing 100. The slider 104 includes a first leg 110 and a second leg 112, which respectively receive the first spring 106 and the second spring 108. The first and second legs 110 and 112 extend into a channel of the housing 100, and each includes a corresponding rim 118, 120. Each spring 106, 108 is engaged with a corresponding one of the rims 118, 120 and an interface of the housing 100. When assembled, the springs 106 and 108 apply a preload to the sliding cam 104 and ensure resetting of the locking module assembly 50. As described in further detail below with reference to FIGS. 13 and 14, a detent spring 122 maintains the locking module assembly 50 in a locked state until the biasing force of the detent spring 122 is overridden by an appropriate unlocking input force. A blocking member 124 interacts with the actuator 60 and housing 100 to effect both adjustment of the locking module 50, and provides for retention and release of the actuator 60 from the inside locking module 50 upon a necessary force provided by a user.

In the illustrated embodiment, the housing 100 of the locking module 50 is mounted to the housing 34 of the inside chassis assembly 33. In other embodiments, the housing 100 may be integrated with the inside chassis assembly 33 such that locking module 50 is not separable from the chassis assembly 33. In such forms, the locking housing 100 and the chassis housing 34 define a monolithic, single-piece component, and are separable only through destruction of some or all of the one-piece component. In one or more embodiments, the combined locking module 50 and chassis housing 34 are formed of cast metal, a cut metal, or a formed plastic material.

Figure 5:
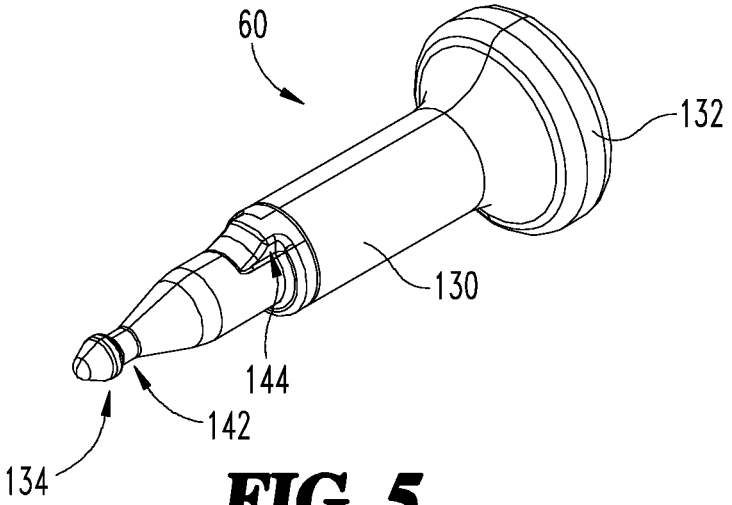
FIG. 5 is a perspective view of a button actuator.
Figure 6:
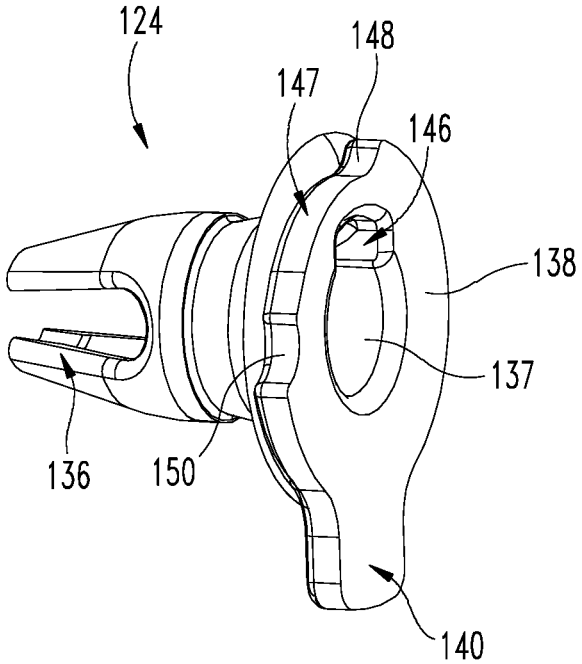
FIG. 6 is a perspective view of a blocking disc.

Referring to FIGS. 5 and 6, the actuator 60 includes a shaft 130, which extends from a user interface 132 disposed at one end of the shaft 130, to a retention nib 134 disposed at another end of the shaft 130. The nib 134 interacts with split jaws 136 of the blocking member 124 to act as a retainer to provide snap-fit, temporary retention of the actuator 60 to the blocking member 124. During assembly, the actuator 60 is inserted into a hole 137 of the blocking member 124. The split jaws 136 are disposed at one end of the blocking member 124, and a disc 138 including a tab 140 is disposed at the other end of the blocking member 124. A groove 142 of the actuator 60 provides clearance for the split jaws 136 to enable the collapse of the jaws 136 behind the nib 134 at the groove 142. Thus, when the actuator 60 is inserted into the blocking member 124 with sufficient force to move the jaws 136 past the nib 134 and to the groove 142, the actuator 60 is retained by the blocking member 124. The split jaws 136 function in a manner similar to cantilever springs that are spread apart or collapsed together within the elastic range of the material. In order to remove the actuator 60 from the blocking member 124, a user pulls the actuator 60 away from the blocking member 124 with a force sufficient to overcome the clamping of the split jaws 136. The actuator 60 is thereby semi-permanently retained by the blocking member 124.

A key 144 disposed on the shaft 130 engages a keyway 146 on the blocking member 124 to rotationally couple the actuator 60 and the blocking member 124. The engaged key 144 and keyway 146 enable the transmission of torque between the actuator 60 and the blocking member 124. A scallop 147 limits the rotation of the blocking member 124 to a selected angular range, such as an angular range of approximately 90 degrees. In other embodiments, the limit to the rotation of the blocking member 128 may be greater than or less than 90 degrees. The scallop 147 includes a first detent 148 and a second detent 150, each of which limit the extent of rotation of the blocking member 124 when rotated by movement of the actuator 60.

Figure 7:
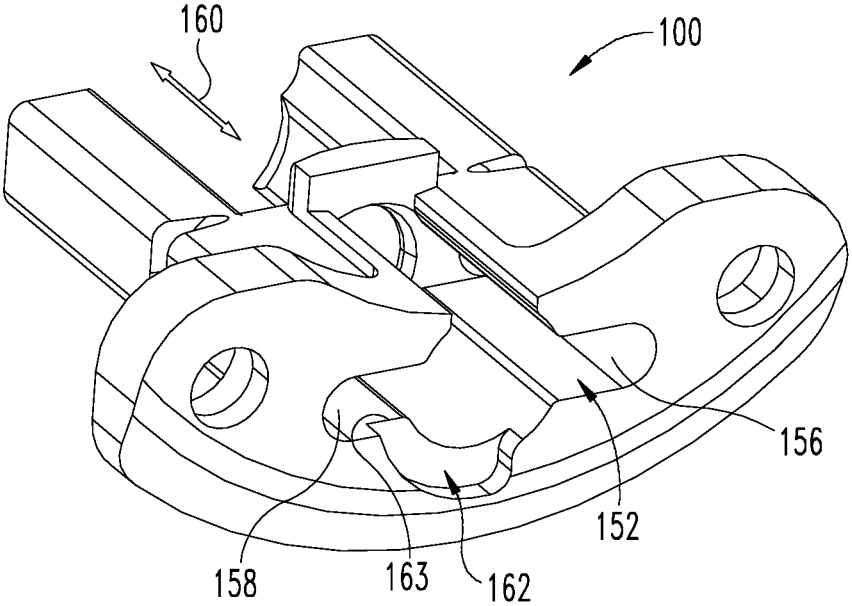
FIG. 7 is a perspective view of a module housing.

FIG. 7 illustrates the housing 100, which includes a channel 152 configured to receive and to provide support for the slider 104. The channel 152 includes a first side 156 and a second side 158, which respectively receive the first leg 110 and the second leg 112 of the slider 104. The channel 152 is configured to restrict rotational movement of the slider 104 with respect to the housing 100, while allowing linear motion along a longitudinal axis 160. A recess 162 formed on a face 164 of the housing 100 engages the blocking tab 140 of the blocking member 124, and an end 163 of the recess 162 terminates at the channel 152.

Figure 8:
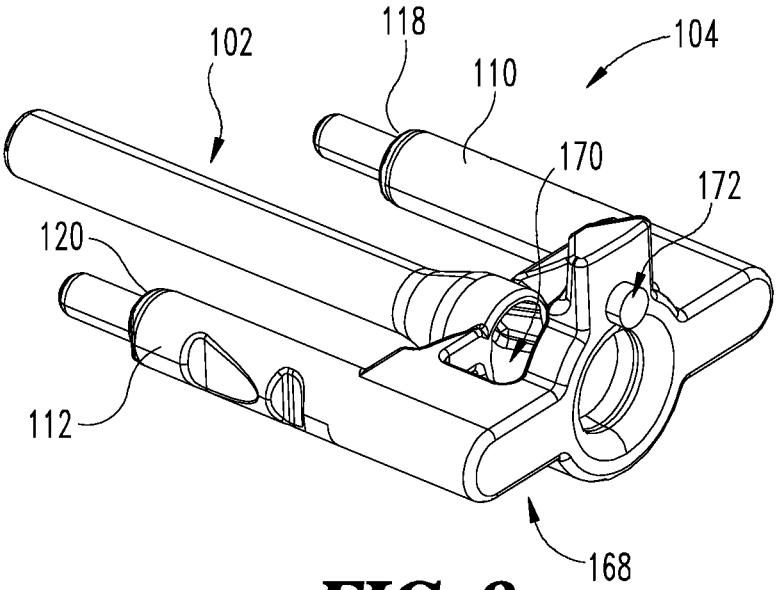
FIG. 8 is a perspective view of a slider.

FIG. 8 illustrates the slider 104, which includes a central body portion 168 from which the first leg 110, the second leg 112, and the post 105 extend. The central portion 168 includes an elongated slot 170 which receives and interacts with the split jaws 136 of the blocking member 124 to enable the jaws 136 to be move between an expanded or free state and a collapsed or restricted state. In the collapsed state, the jaws 136 surround and engage the nib 134 of the actuator 60. A limit stop 172 interacts with the scallop 147 and the detents 148 and 150 of the blocking member 124 to limit rotation of the actuator 60 to a selected angular range, such as an angular range of approximately 90 degrees. In other embodiments, the limit to the rotation of the actuator 60 may be greater than or less than 90 degrees. As described in further detail below, the blocking tab 140 interacts with the recess 162 of the housing 100 to enable or disable locking functionality.

Figure 9:
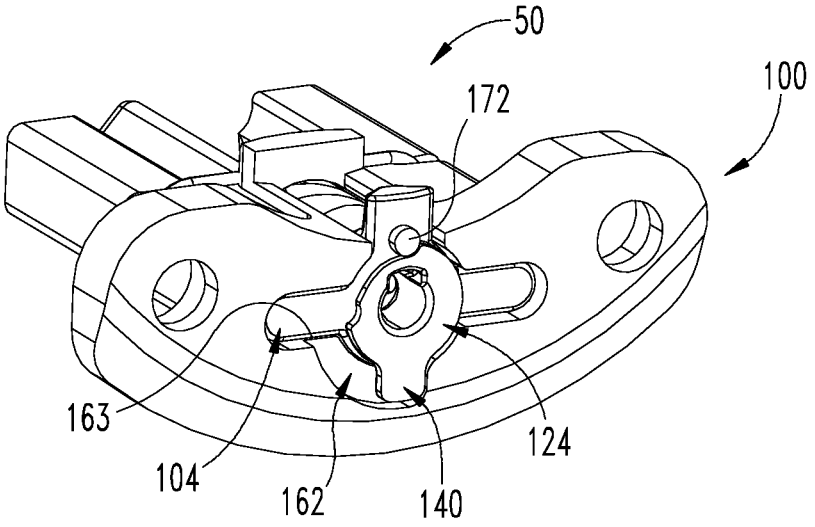
FIG. 9 is a perspective view of a locking mechanism module in a disabled state of a lock.

FIG. 9 illustrates the inside locking module 50 in a disabled state corresponding to the passage configuration of the locking mechanism 70. With the inside locking module 50 in the disabled state, the blocking tab 140 engages a surface of the recess 162 which is configured as an arc of a circle. In this position, the blocking member 124 is fixed against linear motion relative to the housing 100 and only rotates relative to the slider 104 within the selected angular range. With the housing 100 being held fixed relative to the lock, an axial force applied to either the slider 104 or the blocking member 124 does not result in a change of locking state, since linear motion is blocked by the blocking tab 140 against a surface of the recess 162.

Figure 10:
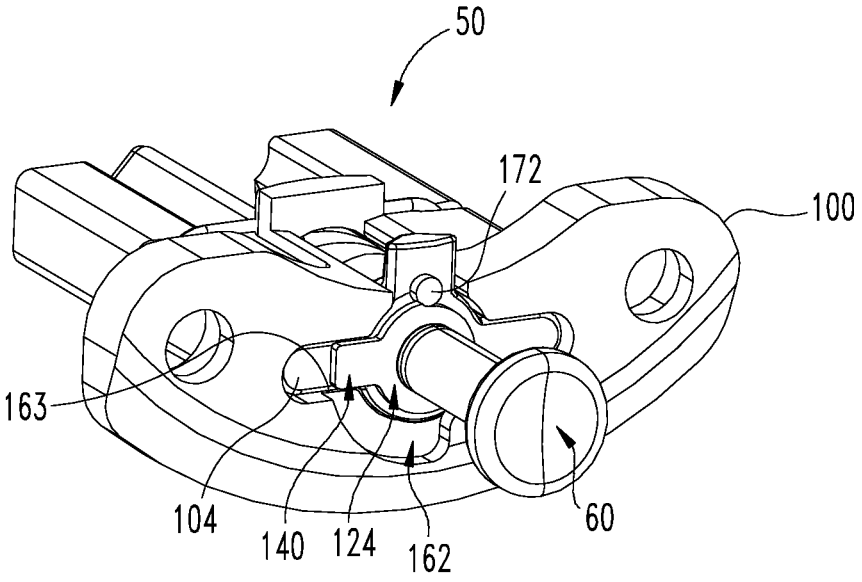
FIG. 10 is a perspective view of a locking mechanism module with an actuator button installed for an enabled state of a lock.

FIG. 10 illustrates the inside locking module 50 in an enabled state corresponding to the privacy configuration of the locking mechanism 70. To convert the locking mechanism 70 from the passage configuration to the privacy configuration, the actuator 60 is installed into the mechanism by inserting the shaft 130 thereof through the hole 137 of the blocking member 124. Thus, the actuator 60 is snapped into the blocking member 124 and then rotated 90 degrees. The 90 degree rotation of the actuator 60 imparts approximately 90 degrees of rotation to the blocking member 124 to move the blocking tab 140 in line with the channel 152 of the housing 100. The blocking tab 140 is now disengaged from the recess 162 of the housing 100 and is free to move axially along the channel 152. As a result, axial motion of the slider 104 is enabled, which enables the locking mechanism to transition between the locked and unlocked states in the manner described hereinafter.

Figure 11:
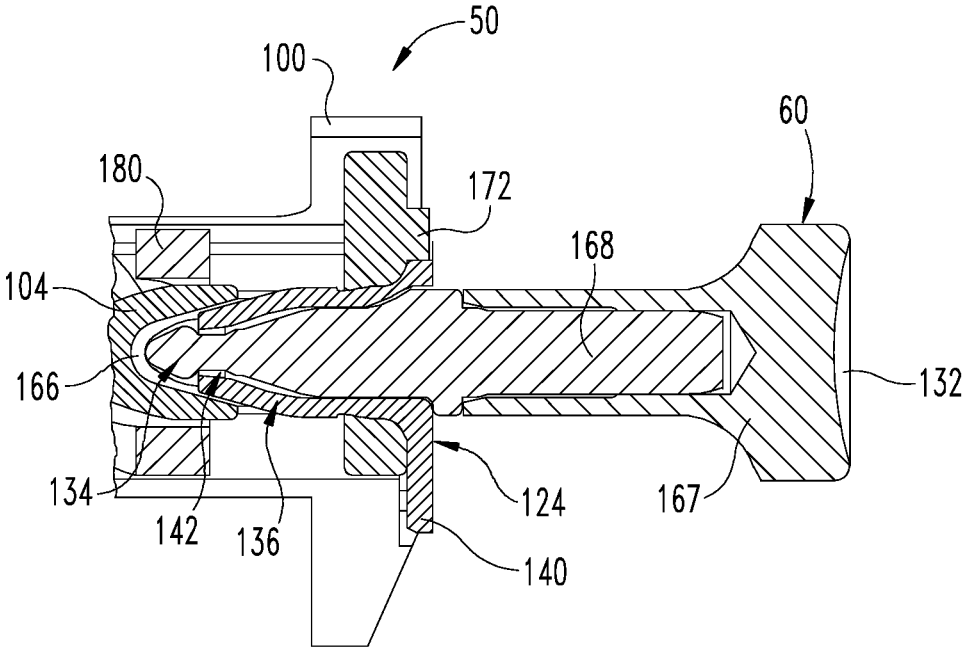
FIG. 11 is a side sectional view of an actuator button inserted into the locking mechanism.

FIG. 11 illustrates a side cross-sectional view of a portion of the module 50 with the actuator 60 installed. Axial insertion of the actuator 60 along its length and/or removal of the actuator 60 engages/disengages the nib 134, which is sized such that it is slightly larger in diameter than the width of the split jaws 136. Thus, while inserting the actuator 60 into the blocking member 124, resistance is encountered when the nib 134 comes into contact with the central geometry of the split jaws 136. Applying additional axial force to the actuator 60 forces the nib 134 through the split jaws 136 and forces the jaws 136 to spread apart. Once the nib 134 travels beyond the end of the blocking member 124, the split jaws 136 snap into the groove 142 of the actuator 60. This provides a temporary axial retention, as well as an audible "click" to indicate proper insertion. In this state, the split jaws 136 of the blocking member 124 are housed within an elongated portion of the elongated slot 166 of the slider 104. The elongated portion allows the split jaws 136 to flex inward or outward as needed to receive the actuator nib 134. The actuator 60 includes a first member 167 forming the user interface 132, here configured as a button, and a shaft 168 inserted into a channel of the first member 167. In this embodiment, the shaft 168 includes the rib 134 and the groove 142. In other embodiments, the actuator 60 is a one-piece part formed of a single unitary member configured that includes the above-described features of the actuator 60.

Figure 12:
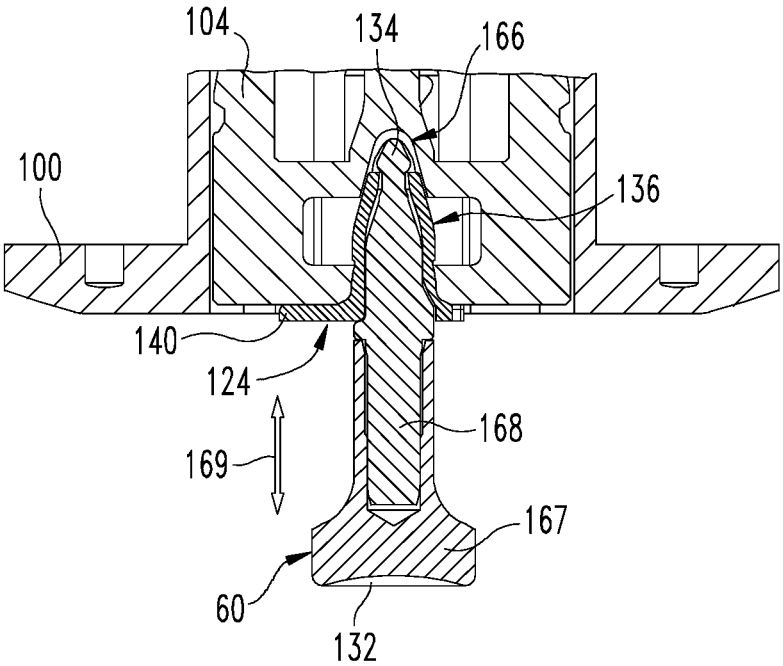
FIG. 12 is a top sectional view of an actuator button rotated 90 degrees from the position of FIG. 9.

FIG. 12 illustrates a top sectional view of the actuator 60 after having been rotated 90 degrees from the position illustrated in FIG. 11. In this state, a semi-permanent axial retention of the actuator 60 to the slider 104 is formed. As the actuator 60 is rotated through 90 degrees, the split jaws 136 of the blocking member 124 rotate with the actuator 60, and the split jaws 136 move from an elongated portion of the elongated slot 166 into engagement with the narrow portion of the elongated slot 166. Movement of the blocking member 124 is along a line 169 and is the result of a camming action of the slider 104, as described below with respect to FIG. 13. This interface is designed such that interference exists when the actuator 60 has been rotated to the position illustrated in FIG. 12. The resulting interference forces the split jaws 136 of the blocking member 124 to flex inward to the groove 142 of the actuator 60. The jaws 136 are held in this position by the narrow portion of the elongated slot 166. Thus, even when subjected to a high axial pulling force along the direction 169, the nib 134 is unable to be pulled through the split jaws 136 of the blocking member 124. This action may prevent accidental removal of the button 60, for example by a child.

Figure 13:
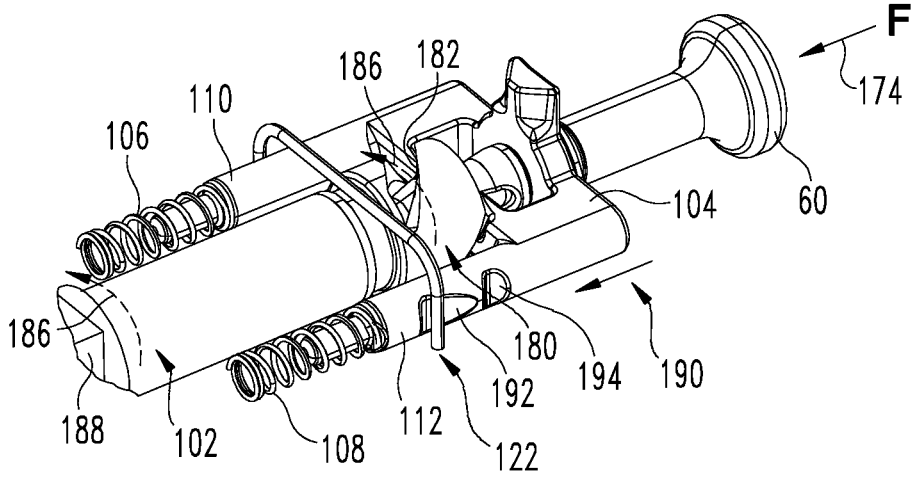
FIG. 13 is a perspective view of a portion of a locking mechanism including a cam shaft, and a locking shaft, with the cam shaft in a first position.

FIG. 13 illustrates a portion of the locking mechanism 70 as the mechanism 70 is moved from the unlocked state to the locked state. In the interest of clarity, certain features of the locking mechanism 70, such as the housing 100, are not illustrated in FIG. 13. The mechanism 70 is shown in an unlocked state. With an external input force F being applied to the push button of the actuator 60 in a direction of the arrow 174, the input force initiates linear translation of the slider 104 in a direction 190. The locking shaft 102 includes a pair of helical cam slots 182, which receive the body portion 168 and convert the linear motion of the slider 104 to rotary motion of the locking shaft 102. The locking shaft 102 is rotationally coupled with the cam shaft 44 of the outside locking module 40. Thus, a rotary motion of the locking shaft 102 along the path 186 is transmitted to rotation of the cam shaft 44, which in turn causes the locking lug 46 to move to the locking position in the manner described above. Furthermore, linear translation of the slider 104 causes deflection of return springs 106 and 108, resulting in an increasing biasing force being applied to the slider 104.

As can be observed from this arrangement, in order to set the locking mechanism 70 to the locked state, the external input force applied along direction 174 should be great enough to overcome the internal spring forces and system friction. The magnitude of the external input force is adjustable by appropriate selection of internal spring forces and component interface friction coefficients. As the slider 104 moves from the unlocked position (FIG. 13) to the locked position (FIG. 14), the detent spring 122 will transition from engagement with a first set of scallops 192 to engagement with a second set of scallops 194. Each set of scallops includes a corresponding scallop on either of the legs 110 and 112. The detent holding performance of this detent arrangement is adjustable by proper selection of spring wire size and by adjusting the scallop geometry.

When the locking mechanism 70 is in the passage configuration (FIG. 9), the blocking member 124 prevents axial motion of the slider 104. As a result, the locking mechanism 70 is not operable in the locked state, thereby preventing operation of the lock assembly 100 as a privacy function lock. Additionally, the locking mechanism 70 can be converted from the passage configuration to the privacy configuration by installing the actuator 60 with a simple pushing force to engage the actuator 60 to the blocking member 124. In certain embodiments, installation of the actuator 60 may involve both insertion and rotation thereof.

When the locking mechanism 70 is in the privacy configuration (FIG. 10), the actuator 60 is not easily removable since the nib 134 is located in a forward position past the jaws 136. By preventing an easy or simple removal of the actuator 60 from the blocking member 124, the privacy function is only provided when the actuator nib 134 is inserted into the blocking member past the jaws 136. Consequently, any risk that the privacy function could remain enabled despite the actuator 60 being removed is substantially reduced or eliminated. Furthermore, the blocking member 124 acts as a retaining member to retain the actuator 60 against being easily removed, and thus, prevents the lock 10 from remaining in a privacy function mode when the actuator 60 is removed.

Figure 14:
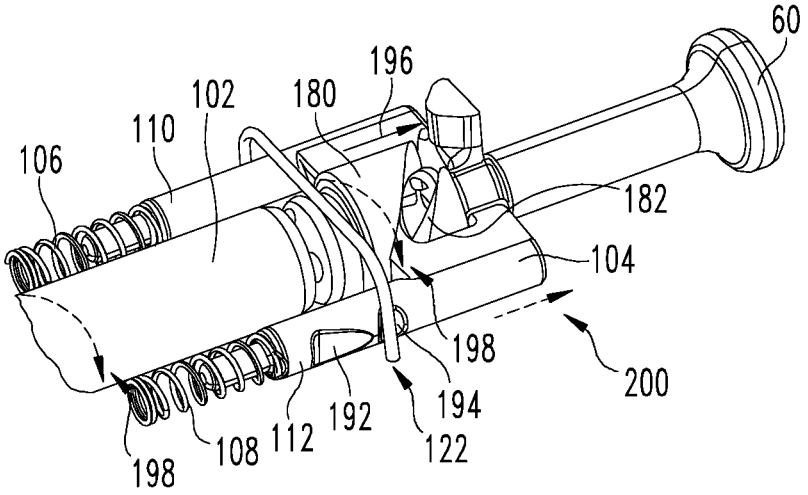
FIG. 14 is a perspective view of a portion of a locking mechanism including a cam shaft, and a locking shaft with the cam shaft in a second position.

FIG. 14 illustrates a portion of the locking mechanism 70 as the mechanism 70 is moved from the locked state to the unlocked state. In the locked state, the springs 106 and 108 are set in a cocked state, while the detent spring 122 and the slider 104 act as the release mechanism. In the absence of an external force applied to the slider 104, the mechanism remains in the cocked state and the lock remains locked. Upon application of a sufficient force along the line 196 to overcome the holding force provided by the detent spring 122, the return springs 106, 108 return the mechanism 70 to the unlocked state by moving the slider 104 in the direction 200. As the slider 104 moves in the direction 200, the helical slots 182 cause the locking shaft 102, which in turn rotates the cam shaft 44. Rotation of the cam shaft 44 permits the locking lug 46 to move to the unlocking position under the urging of the biasing element 48. A force developed by the rotation of the cam shaft 44, which is sufficient to move the spring 122 from the scallops 194, moves the slider 104 sufficiently to the location illustrated in FIG. 11.

Figure 15:
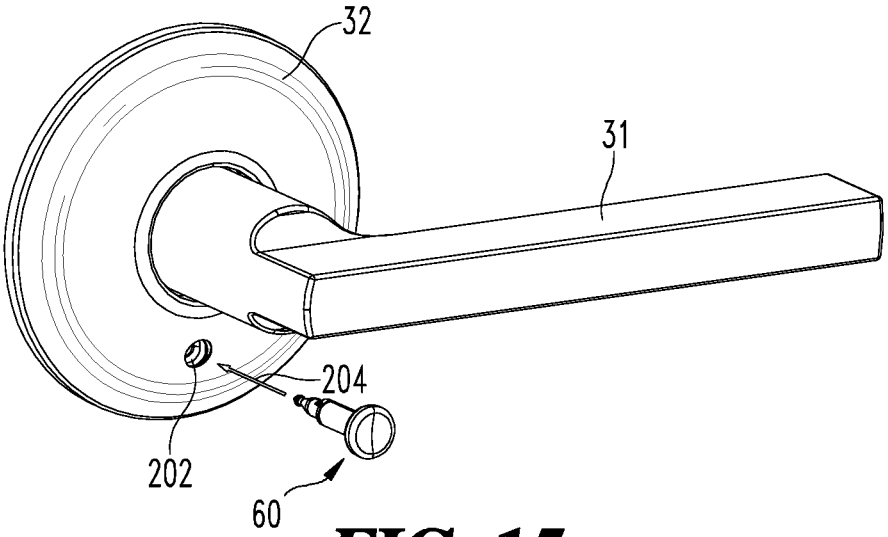
FIG. 15 is a perspective view of an actuator button before insertion into a rose of a lock assembly.
Figure 16:
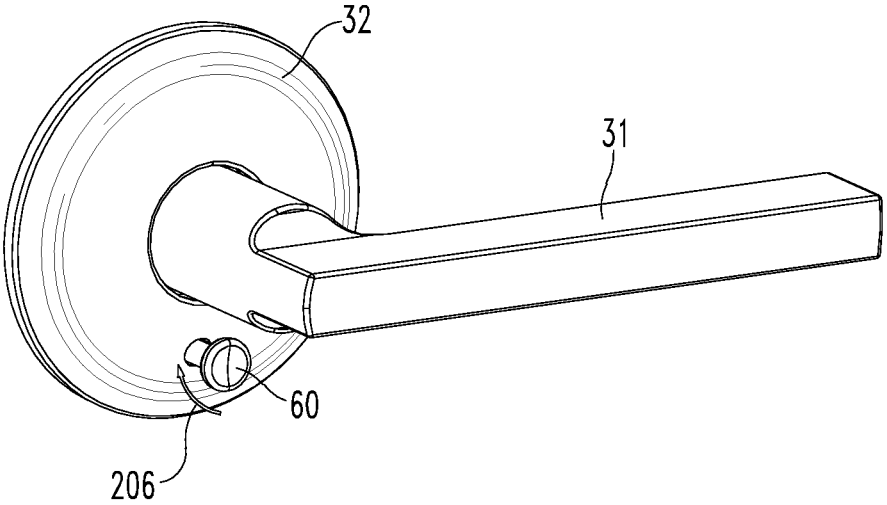
FIG. 16 is a perspective view of an actuator button after insertion into a rose of a lock assembly.

FIGS. 15 and 16 respectively illustrate first and second steps of the process by which the actuator 60 is installed to set the locking mechanism 70 in the privacy mode. In the first step (FIG. 15), the actuator 60 is inserted axially through a hole 202 in the rose 72 along a line 204. Axial insertion without further movement provides temporary retention of the actuator 60 via the snap-fit interface, which is overridden, if needed, by applying a sufficiently high pulling force to the actuator 60. Insertion of the actuator 60, without further movement, does not necessarily enable the locking mechanism 70. As a result, applying a pushing force to the button 132 at this stage does not set the locking mechanism 70 to the locked state. In the second step (FIG. 16), the actuator 60 is rotated approximately 90 degrees in a first rotational direction 206. This action provides semi-permanent retention of the actuator 60, safeguarding against removal by an applied axial pulling force. Installation of the actuator 60 enables the locking mechanism 70 and sets the lock 10 to the privacy mode.

A removal process for the actuator 60 is provided by reversing the steps of the installation process, which also configures the lock 10 for passage mode operation. In a first step of the removal process, the actuator 60 is rotated approximately 90 degrees in a second rotational direction opposite the direction 206. This action releases the semi-permanent retention of the actuator 60, thereby enabling the actuator 60 to be removed by a sufficiently high axial pulling force. It also places the locking mechanism 70 in the disables state. An axial pulling force is then applied to the actuator 60 in a direction opposite the direction 204 to override the temporary snap-fit retention of the actuator 60. This action completes the removal process. With the actuator 60 removed, applying a pushing force to the internal components of the locking mechanism with an adequately sized foreign object does not result in setting the lock to the locked state.

As is evident from the foregoing, the configurable nature of the lock assembly 70 enables the lockset 10 to be installed in either the privacy configuration or the passage configuration. This capability may simplify the purchasing experience for consumers, particularly those who desire to provide some doors with a privacy function and other doors with a passage function. For example, the fact that a single lockset 10 is capable of being installed in each of the desired configurations may obviate the need for the consumer to determine the exact quantity of each needed function prior to making a purchase. Instead, the consumer simply selects the desired style and finish for the locksets 10, and purchases the correct total quantity of locksets 10. The locksets 10 can then be configured for the desired functionality at the point of installation. Additionally, should the consumer change his or her mind regarding the function desired for one or more of the doors after purchase, the corresponding lockset 10 can be assembled in the newly desired function at the time of installation.

The configurable nature of the lock assembly 70 also enables conversion between the privacy and passage configurations after the lockset 10 has been installed. This enables the lockset 10 to be reconfigured by the consumer to adapt to possible changes in the use of a particular door. In a residential setting, the use of a particular room may change with time or with occupancy. In such situations, the lock functionality can be correspondingly changed to provide either passage or privacy operation as desired. Additionally, should the consumer change his or her mind regarding the function desired for one or more of the doors after installation, the already-installed lockset 10 can be reconfigured in the newly desired function by installing or removing the actuator 60.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A configurable lockset, comprising:

an outside chassis assembly, comprising:

an outside chassis housing;

an outside rose covering at least a portion of the outside chassis housing; and an outside spindle rotatably mounted to the outside chassis housing;

an inside chassis assembly, comprising:

an inside chassis housing;

an inside rose covering at least a portion of the inside chassis housing; and an inside spindle rotatably mounted to the inside chassis housing;

a lock mechanism, comprising:

an outside lock housing mounted to the outside chassis housing;

a locking member movably mounted to the outside lock housing, the locking member having a locking position in which the locking member prevents rotation of the outside spindle, the locking member having an unlocking position in which the locking member does not prevent rotation of the outside spindle;

an inside lock housing mounted to the inside chassis housing; and a blocking member movably mounted to the inside lock housing, the blocking member having a blocking position in which axial movement of the blocking member is prevented, the blocking member having an unblocking position in which axial movement of the blocking member is permitted;

wherein the blocking member is aligned with an opening in the inside rose; and wherein the blocking member is operably coupled with the locking member such that axial movement of the blocking member drives the locking member between the locking position and the unlocking position; and an actuator selectively engaged with the blocking member;

wherein the lockset has a first configuration in which the actuator extends through the opening in the inside rose and is engaged with the blocking member, the blocking member is in the unblocking position, and the actuator is operable to axially drive the blocking member to move the locking member between the unlocking position and the locking position; and wherein the lockset has a second configuration in which the actuator is disengaged from the blocking member, and the blocking member is in the blocking position such that the locking member is retained in the unlocking position.

2. The configurable lockset of claim 1, wherein the blocking member is configured to rotate between the blocking position and the unblocking position.

3. The configurable lockset of claim 1, wherein, with the actuator engaged with the blocking member and the blocking member in the blocking position, the lock mechanism is configured to permit removal of the actuator from the blocking member, thereby enabling the lockset to transition from the first configuration to the second configuration; and wherein, with the actuator engaged with the blocking member and the blocking member in the unblocking position, the lock mechanism is configured to prevent removal of the actuator from the blocking member, thereby retaining the lockset in the first configuration.

4. The configurable lockset of claim 1, wherein the outside spindle is rotatable about a rotational axis; and wherein the locking member is configured to move between the locking position and the unlocking position in directions transverse to the rotational axis.

5. The configurable lockset of claim 1, wherein the blocking member comprises a jaw clamp selectively engaged with a nib of the actuator; and wherein the locking mechanism in the first configuration is configured to prevent removal of the actuator by preventing expansion of the jaw clamp.

6. A method of converting a configurable lockset between a privacy mode and a passage mode, the method comprising:

installing a lockset to a door in one of the privacy mode and the passage mode, the lockset comprising:

a latch;

an outside chassis assembly engaged with the latch;

an inside chassis assembly engaged with the latch and defining an opening;

a lock mechanism engaged with each of the outside chassis assembly and the inside chassis assembly, the lock mechanism having a locked state in which the lock mechanism prevents the outside chassis assembly from retracting the latch, the lock mechanism having an unlocked state in which the outside chassis assembly is capable of retracting the latch; and an actuator having an engaged state in which the actuator is inserted into the opening and engaged with the lock mechanism, and a disengaged state in which the actuator is disengaged from the lock mechanism and separated from the lockset and wherein the opening is exposed in the disengaged state;

wherein, in the privacy mode, the actuator is in the engaged state and is operable to move the lock mechanism between the locked state and the unlocked state; and wherein, in the passage mode, the actuator is in the disengaged state and the lock mechanism is prevented from transitioning to the locked state;

converting the lockset from the one of the privacy mode and the passage mode to the other of the privacy mode and the passage mode;

with the lockset in the privacy mode, permitting manipulation of the lock mechanism by the actuator; and with the lockset in the passage mode, preventing a foreign object inserted into the opening from manipulating the lock mechanism.

7. The method of claim 6, wherein the lockset further comprises a blocking member aligned with the opening;

wherein the lock mechanism is configured to move between the locked state and the unlocked state in response to axial movement of the blocking member;

wherein the blocking member has an unblocking position in which axial movement of the blocking member is enabled, the blocking member positioned in the unblocking position when the lockset is in the privacy mode; and wherein the blocking member has a blocking position in which axial movement of the blocking member is prevented, the blocking member positioned in the blocking position when the lockset is in the passage mode.

8. The method of claim 7, wherein moving the actuator from the disengaged state to the engaged state comprises inserting a tip of the actuator into the opening, engaging the tip of the actuator with the blocking member, and rotating the actuator to rotate the blocking member from the blocking position to the unblocking position; and wherein moving the actuator from the engaged state to the disengaged state comprises rotating the actuator to rotate the blocking member from the unblocking position to the unblocking position, disengaging the tip of the actuator from the blocking member, and removing the actuator from the opening.

9. The method of claim 6, wherein the lock mechanism further comprises a blocking member operable to engage the actuator and configured to selectively prevent movement of the lock mechanism from the locked state to the unlocked state, the blocking member having a blocking position in which the blocking member retains the lock mechanism in the unlocked state, and the blocking member having an unblocking position in which the blocking member permits movement of the lock mechanism between the unlocked state and the locked state;

wherein moving the actuator from the disengaged state to the engaged state comprises engaging the actuator with the blocking member and subsequently moving the blocking member from the blocking position to the unblocking position; and wherein moving the actuator from the engaged state to the disengaged state comprises moving the blocking member from the unblocking position to the blocking position and subsequently disengaging the actuator from the blocking member.

10. The method of claim 9, wherein moving the actuator from the disengaged state to the engaged state includes moving the actuator linearly to engage the actuator with the blocking member, and subsequently rotating the actuator to move the blocking member from the blocking position to the unblocking position; and wherein moving the actuator from the engaged state to the disengaged state includes rotating the actuator to move the blocking member from the unblocking position to the blocking position, and subsequently moving the actuator linearly to disengage the actuator from the blocking member.

11. The method of claim 6, wherein converting the lockset from the passage mode to the privacy mode comprises inserting the actuator into an opening in the inside chassis assembly and moving the actuator from the disengaged state to the engaged state; and wherein converting the lockset from the privacy mode to the passage mode comprises moving the actuator from the engaged state to the disengaged state, thereby detaching the actuator from the lockset and exposing the opening.

12. A door lock, comprising:

an outside chassis;

an inside chassis defining an opening;

a lock mechanism comprising a locking member having a locked position in which the locking member provides the outside chassis with a locked state, the and an unlocked position in which the locking member provides the outside chassis with an unlocked state; and an actuator operable to engage the lock mechanism when inserted into the opening, the actuator having an engaged condition in which the actuator is inserted into the opening and engaged with the lock mechanism such that the actuator is operable to move the locking member between the locked position and the unlocked position, the actuator having a disengaged condition in which the actuator is fully removed from the opening and separated from the lock mechanism and the locking member remains in the unlocked position;

wherein the lock mechanism has a disabled state in which a foreign object inserted through the opening is unable to move the locking member from the unlocked position to the locked position;

wherein the lock mechanism has an enabled state in which the actuator is inserted through the opening and is operable to move the locking member from the unlocked position to the locked position; and wherein installation of the actuator moves the lock mechanism from the disabled state to the enabled state.

13. The door lock of claim 12, wherein with the lock mechanism in the enabled state and the actuator in the engaged condition:

the actuator is operable to move between a locking position and an unlocking position; and wherein the locking member is configured to move between the locked position and the unlocked position as a result of movement of the actuator between the locking position and the unlocking position.

14. The door lock of claim 12, wherein the lock mechanism has an additional blocking configuration in which the actuator is in a partially-engaged condition; and wherein with the lock mechanism in the additional blocking configuration and the actuator in the partially-engaged condition, the lock mechanism is configured to retain the actuator in the unlocking position, thereby preventing the actuator from moving the locking member to the locking position.

15. The door lock of claim 12, wherein the lock mechanism comprises a blocking member operably connected with the locking member;

wherein the locking member is configured to move between the locked position and the unlocked position in response to axial movement of the blocking member;

wherein the blocking member has an unblocking position in which axial movement of the blocking member is enabled, and wherein the blocking member having the unblocking position when the lock mechanism is in the first configuration; and wherein the blocking member has a blocking position in which axial movement of the blocking member is prevented, the blocking member having the blocking position when the lock mechanism is in the second configuration.

16. The door lock of claim 15, wherein the actuator, when engaged with the blocking member, is operable to rotate the blocking member between the blocking position and the unblocking position.

17. The door lock of claim 15, wherein the inside chassis comprises an inside rose defining the opening, and wherein the blocking member is aligned with the opening such that the actuator is operable to engage the blocking member when inserted into the opening.

18. The door lock of claim 12, wherein the lock mechanism comprises an outside lock module engaged with the outside chassis and an inside lock module engaged with the inside chassis;

wherein the actuator is removably engaged with the inside lock module; and wherein the outside lock module comprises the locking member.

19. The door lock of claim 12, further comprising a blocking member configured to prevent the foreign object from moving the locking member from the unlocked position to the locked position when the lock mechanism is in the disabled state.

20. The door lock of claim 19, wherein the actuator when in the engaged condition is engaged with the locking member via the blocking member.

21. The door lock of claim 12, further comprising a latch engaged with each of the outside chassis and the inside chassis;

wherein, in the locked state, the outside chassis is prevented from retracting the latch; and wherein, in the unlocked state, the outside chassis is capable of retracting the latch.

* * * * *